United States Patent [19]

Watanabe et al.

[11] Patent Number: 4,841,748

[45] Date of Patent: Jun. 27, 1989

[54] JACQUARD CIRCULAR KNITTING MACHINE

[75] Inventors: Fumio Watanabe, Fujimi; Toshio Watanabe, Saitama; Chiharu Watanabe, Fujimi; Yuji Watanabe, Tokyo; Yoshinori Watanabe, Yono, all of Japan

[73] Assignee: Watanabe Kutsushita Kogyo Co., Ltd., Saitama, Japan

[21] Appl. No.: 228,846

[22] Filed: Aug. 3, 1988

Related U.S. Application Data

[63] Continuation of Ser. No. 917,237, Oct. 7, 1986, abandoned, which is a continuation of Ser. No. 680,552, Dec. 11, 1984, abandoned.

[30] Foreign Application Priority Data

Dec. 19, 1983 [JP] Japan ..... 58-237960
Dec. 7, 1984 [JP] Japan ..... 59-257475

[51] Int. Cl.[4] ..... D04B 9/36; D04B 15/78; D04B 15/60; D04B 35/10

[52] U.S. Cl. ..... 66/218; 66/43; 66/56; 66/140 R; 66/163

[58] Field of Search ..... 66/43, 56, 138, 140 R, 66/140 S, 157, 163, 215, 216, 218, 219, 232

[56] References Cited

U.S. PATENT DOCUMENTS

| | | | |
|---|---|---|---|
| 3,232,079 | 2/1966 | Levine et al. | 66/232 |
| 3,570,267 | 3/1971 | Kurka | 66/56 |
| 3,653,231 | 4/1972 | Gell et al. | 66/56 |
| 3,788,105 | 1/1974 | Brose | 66/163 X |
| 3,831,402 | 8/1974 | Schuman | 66/218 |
| 3,896,638 | 7/1975 | Gottschall et al. | 66/232 X |
| 3,945,224 | 3/1976 | Billi | 66/232 X |
| 4,041,733 | 8/1977 | Brada et al. | 66/138 |
| 4,366,681 | 1/1983 | Homocky et al. | 66/157 X |
| 4,628,710 | 12/1986 | Jacobsson | 66/138 X |

FOREIGN PATENT DOCUMENTS

| | | | |
|---|---|---|---|
| 26425 | 4/1981 | European Pat. Off. | 66/232 |
| 56619 | 7/1982 | European Pat. Off. | 66/232 |
| 1040000 | 9/1983 | U.S.S.R. | 66/215 |
| 1325316 | 8/1973 | United Kingdom | 66/56 |
| 1328757 | 9/1973 | United Kingdom | 66/138 |

*Primary Examiner*—Wm. Carter Reynolds
*Attorney, Agent, or Firm*—Burns, Doane, Swecker & Mathis

[57] ABSTRACT

A jacquard circular knitting machine provided with a needle cylinder driving mechanism capable of optionally and readily controlling the rotary motion of the needle cylinder according to the pattern to be knitted. A motor interlocked through gears or the like with the needle cylinder rotates according to a needle cylinder rotating procedure stored previously in a magnetic memory medium. Actuators operate according to a pattern forming procedure stored in another magnetic memory medium as a signal is provided by a sensor for detecting the rotary motion of the needle cylinder. Thus a jacquard circular-knitted fabric having predetermined patterns can be knitted efficiently. In addition to the above, a machine is provided with a third magnetic memory medium for storing a yarn feed element switching procedure to carry out a plurality of yarn feed element switching operations at optional timings when necessary while a single course of a fabric is knitted. A yarn feed element switching device is actuated according to the signals given thereto by the third magnetic memory medium as a signal is provided by the sensor for detecting the rotary motion of the needle cylinder. Thus a number of colored yarns exceeding the number of the yarn feed units can be stitched efficiently into a single course of a knitted fabric.

14 Claims, 18 Drawing Sheets

KNITTING OPERATION CONTROL ROUTINE

JACQUARD CIRCULAR KNITTING MACHINE

This application is a continuation of application Ser. No. 917,237, filed Oct. 7, 1986, now abandoned, which is continuation of application Ser. No. 680,652, filed Dec. 11, 1984, abandoned.

BACKGROUND OF THE INVENTION

1. Field of the Invention

The present invention relates to a jacquard circular knitting machine, more specifically to a jacquard circular knitting machine provided with a needle cylinder driving mechanism capable of optionally and readily changing the rotary motion of the needle cylinder of the circular knitting machine according to the pattern to be produced on the fabric.

2. Description of the Related Art

As is well known, a jacquard circular knitting machine such as a hosiery knitting machine includes a cylindrical needle cylinder provided with a plurality of knitting needles, a patterning mechanism for controlling the vertical sliding motion of the knitting needles on the knitting cylinder to knit a jacquard knitted fabric, and a driving mechanism for driving the needle cylinder. Usually, the patterning mechanism employs a pin drum or pin drums for controlling the knitting needles. In recent years, however, computers have been employed in the patterning mechanism. A patterning mechanism employing a computer, namely, a computerized patterning mechanism, has an infinite patterning capacity. That is, by controlling all the individual knitting needles, the computerized patterning mechanism is capable of changing stitches along the wale direction and is capable of producing diversified patterns in the course direction, as compared with the pin drum type patterning mechanism. Furthermore, the computerized patterning mechanism has the advantage that it enables quick and very easy pattern changes without requiring a skilled worker.

On the other hand, in the conventional jacquard circular knitting machine, a driving mechanism, another essential mechanism for the jacquard knitting operation of a jacquard circular knitting machine, of a mechanical type is used. This conventional driving mechanism includes a transmission mechanism for transmitting the driving force of the motor and changing the rotation speed thereof and, for a jacquard hosiery knitting machine, additionally includes a mechanism for changing the direction of rotation of the needle cylinder between the normal direction and the reverse direction, namely, a reversing mechanism. In a circular knitting machine equipped with a reversing mechanism, the needle cylinder is rotated through necessary angles of rotation in the normal and reverse directions according to the pattern to be knitted in the knitting part of the fabric having a pattern, which prevents idle rotation of the needle cylinder. However, changing the revolving rate and the angle of rotation of the needle cylinder according to a pattern to be kntted requires a complex mechanical driving mechanism. Therefore, the circular knitting machine becomes costly and difficult to operate. Even in a conventional jacquard circular knitting machine, which is incapable of the abovementioned additional special performance, it is necessary to replace the sector gear or the equivalent of the reversing mechanism according to a new pattern when changing the pattern, which requires a long time.

Ordinarily, the number of colored yarns which can be stitched into one course is the same as or less than the number of yarn feed units, i.e., the number of knitting stations, provided around the needle cylinder. When a number of colored yarns exceeding the number of the yarn feed units needs to be stitched into one course, one or more of the yarn feed units needs to be equipped with a plurality of yarn feed elements. These yarn feed elements need to be changed a plurality of times during the knitting of one course. A typical pattern which requires such a change of the yarn feed elements is a diamond pattern, i.e., an argyle design, having a stitch pattern. More concretely, a diamond pattern having a stitch pattern is knitted by changing, at a particular knitting station, a yarn feed element for feeding a yarn for knitting the diamond pattern to a yarn feed element, for feeding a yarn for knitting the stitch pattern and, after a predetermined number of stitches has been knitted, by changing the same yarn feed element for feeding the yarn for knitting the stitch pattern to the yarn feed element, for feeding the yarn for knitting the diamond pattern. The mechanism of the conventional jacquard circular knitting machine is incapable of changing the yarn feed elements during a knitting operation with the needle cylinder positioned at any angular position. Accordingly, in order to change the yarn feed elements on a conventional jacquard circular knitting machine, it has been necessary to reverse the direction of rotation of the needle cylinder before changing the yarn feed elements. Namely, for example, the conventional jacquard circular knitting machine has been obliged to knit the diamond pattern and the stitch pattern separately. That is, one course of the diamond pattern having the stitch pattern has been knitted by one full rotation in the normal direction and one full rotation in the reverse direction of the needle cylinder. Accordingly, a time twice as long as the time for knitting only the diamond pattern is required for knitting a diamond pattern having the stitch pattern, with a resultant reduction of production efficiency.

SUMMARY OF THE INVENTION

Accordingly, it is an object of the present invention to provide a jacquard circular knitting machine equipped with a needle cylinder driving mechanism free from the above-mentioned disadvantages of the well-known conventional jacquard circular knitting machine and capable of freely and readily changing the rotary motion of the needle cylinder according to the pattern to be knitted thereon. It is another object of the present invention to provide a jacquard circular knitting machine capable of stitching a number of colored yarns exceeding the number of the yarn feed units thereof while the needle cylinder thereof is rotated continuously in one direction, in knitting a knitted fabric designed to have stitches of a number of colored yarns exceeding the number of the yarn feed units in one course of stitches.

In a jacquard circular knitting machine including a cylindrical needle cylinder prdvided with a plurality of knitting needles, a patterning mechanism for forming a jacquard pattern by controlling the vertical sliding motion of the needles on the needle cylinder at least individually, and a driving mechanism for driving the needle cylinder, the objects of the present invention are achieved by:

(a) a driving mechanism including a bidirectional electric motor operatively connected through mechanical transmission means to the needle cylinder and a first controller which successively gives control signals to the motor to control the rotary motion thereof for the controlled operation of the motor;

(b) a first controller including cylinder motion memory means for storing a predetermined operating procedure of the needle cylinder, first detecting means for detecting the angle of rotation of the needle cylinder, second detecting means for detecting the abnormal action of the yarn fed to the needle cylinder and/or the circular knitting machine, first reading and instructing means which compares the signal received from the first detecting means with the contents of the memory means and gives an instruction including the conditions of the rotary motion of the needle cylinder to the motor, and stop instructing means which gives a signal to stop the motor upon the reception of a signal given by the second detecting means;

(c) a patterning mechanism including pattern forming means, which operates the patterning functional members of the jacquard circular knitting machine, and a second controller, which successively gives signals to the pattern forming means to control the pattern forming means; and (d) a second controller including pattern memory means, for storing a predetermined working procedure of the patterning functional members, and second reading and instructing means, which compares a signal provided by the first detecting means of the first controller and the contents of the pattern memory means and then instructs the pattern forming means for actuating the patterning functional members; whereby the needle cylinder is driven for the predetermined rotary motion to knit a jacquard fabric in cooperation with the patterning mechanism.

When a plurality of knitting needles mounted on the needle cylinder are used as the patterning functional members, the pattern forming means is needle driving means, to drive the knitting needle for vertical sliding motion, and the pattern memory means is first pattern memory means, to store a predetermined needle driving procedure, the needle cylinder can be rotated efficiently without the need for a complex mechanical mechanism, which remarkably reduces the time required for producing a jacquard fabric.

When the jacquard circular knitting machine includes a plurality of yarn feed units, each being disposed at a predetermined position in the vicinity of the needle cylinder and having a plurality of yarn feed elements; a plurality of knitting needles mounted on the needle cylinder and a plurality of yarn feed units, each being disposed at a predetermined position in the vicinity of the needle cylinder and having a plurality of yarn feed elements, are used as the patterning functional members; the pattern forming means includes needle driving means to drive the knitting needles for vertical sliding motion on the needle cylinder and yarn feed element switching means to set one or a plurality of the yarn feed elements of the yarn feed units at the yarn feed position or retracting the same from the yarn feed position; and the pattern memory means includes first pattern memory means to store a predetermined needle driving procedure for driving the knitting needle and second pattern memory means to store a predetermined yarn feed element switching procedure for switching the yarn feed elements; a knitted fabric having stitches of a number of colored yarns exceeding the number of the yarn feed units in a course can be knitted without reducing the production speed.

A jacquard knitted fabric can be produced through the rotation of the needle cylinder both in the normal and the reverse directions by storing a control procedure for selectively and properly controlling the rotation speed, number of turns, direction of rotation, and stopping position of the needle cylinder in the cylinder motion memory means.

Most preferably, the essential part of the first controller and/or the second controller is a computer or computers. The employment of a computer enhances the processing speed, enables diversified processing procedures, and reduces the size and weight of the controller.

Various means are available as the cylinder motion memory, the first pattern memory means, or the second pattern memory means; floppy disks, mark sheets, or the like may be employed as necessary. The predetermined control procedure for controlling the operation of the needle cylinder, the predetermined needle control procedure for controlling the vertical sliding motion of the knitting needles, and the predetermined yarn feed element switching procedure may be stored in the same memory means.

BRIEF DESCRIPTION OF THE DRAWINGS

The present invention will be described hereinafter in connection with the accompanying drawings showing preferred embodiments of the present invention, in which:

FIGS. 12A-1 and 12A-2, disposed side by side, compose FIG. 12A.

DESCRIPTION OF THE PREFERRED EMBODIMENTS

Figure 1:
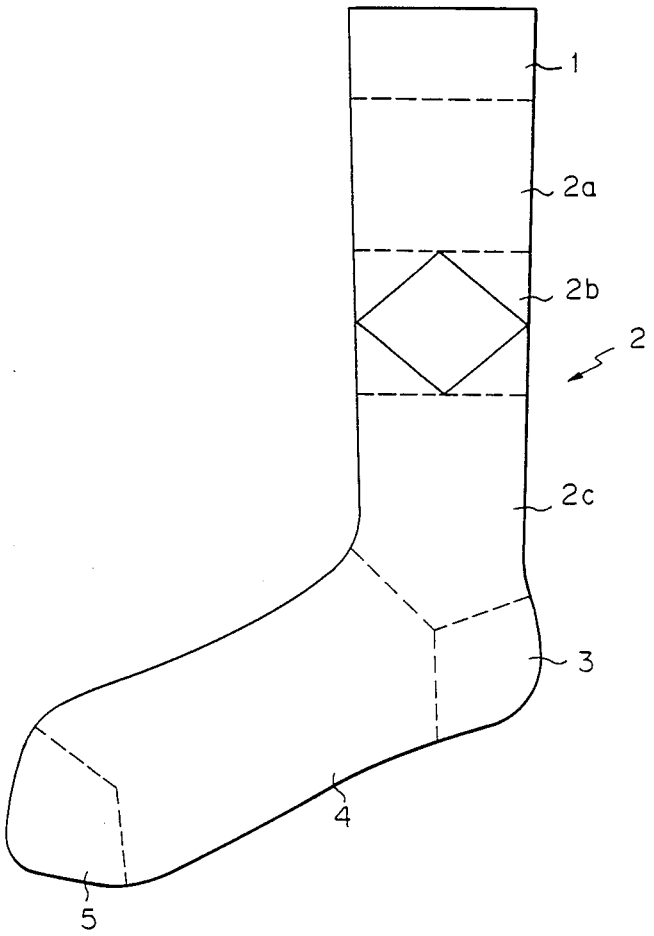
FIG. 1 is a front elevation of a sock knitted on a jacquard circular knitting machine according to the present invention.

FIG. 1 shows an example of a sock knitted on a jacquard circular knitting machine according to the present invention. The sock shown in FIG. 1 includes a rib top section 1, a leg section 2, a heel section 3, an instep and sole section 4 and a toe section 5. A diamond pattern is knitted substantially in the central portion of the leg section 2. In FIG. 1, broken lines are imaginary boundary lines between the sections, not patterns. The diamond pattern is employed only by way of example for explaining the operation of a jacquard circular knitting machine according to the present invention. Patterns to be knitted on the jacquard circular knitting machine are not limited to the diamond pattern.

Figure 2:
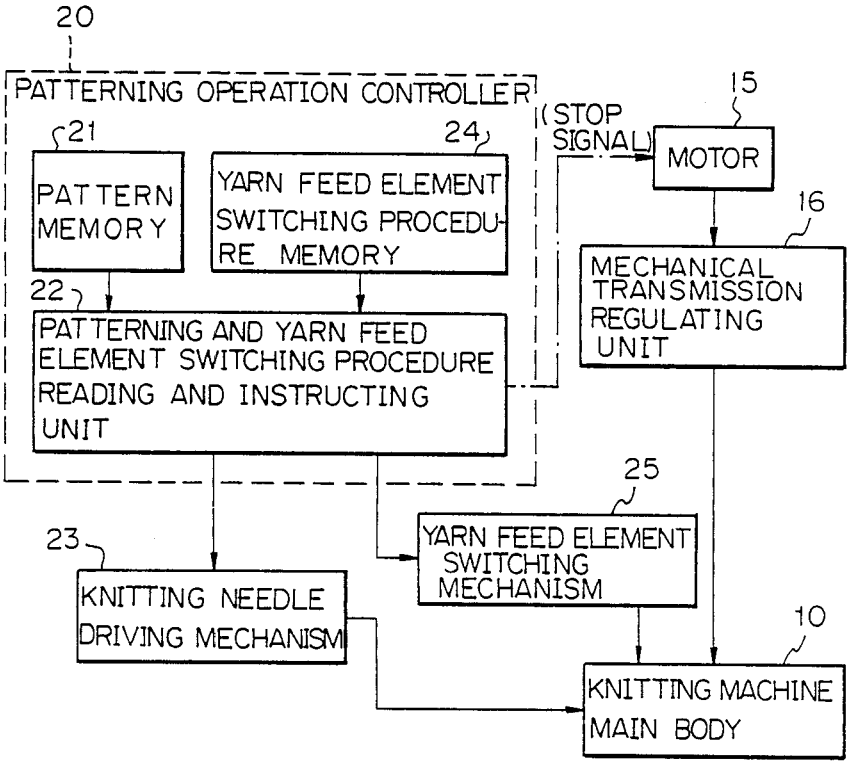
Fig. 2 PRIOR ART
FIG. 2 is a block diagram of the control mechanism of a well-known conventional jacquard circular knitting machine.

FIG. 2 is a block diagram of the operation of a well-known conventional jacquard circular knitting machine. As is well known, a needle cylinder mounted on a knitting machine main body 10 is driven through a mechanical transmission regulating unit 16 by a motor 15. The mechanical transmission regulating unit 16 includes a reduction gear and a reversing mechanism for changing the direction of rotation of the needle cylinder between the normal and the reverse directions. A patterning operation controller 20 includes a first pattern memory 21, a yarn feed element switching procedure memory 24, and a patterning and yarn feed element switching procedure reading and instructing unit 22. A knitting needle driving mechanism 23 and a yarn feed element switching mechanism 25 control a plurality of knitting needles mounted on the needle cylinder and switch yarn feed elements according to an instruction given by the patterning and yarn feed element switching procedure reading and instructing unit 22 to knit a pattern. The patterning operation controller 20 conventionally has been a mechanical means employing pin drums as the first pattern memory 21 and the yarn feed element switching procedure memory 24, however, in recent years, a computer using magnetic tapes or the like has come into use as the first pattern memory 21 and the yarn feed element switching procedure memory 24, which enables diversified patterning operation and easy pattern changing work.

The constitution of a first embodiment of the present invention will be described hereinafter with reference to the block diagram shown in FIG. 3 and the perspective view of FIG. 4. As apparent from the comparison of the block diagrams of FIGS. 2 and 3, according to the present invention, the mechanical transmission regulating unit 16 is substituted by a mechanical transmission unit 17 and a first controller 30. The mechanical transmission unit 17 transmits the rotation of the bidirectional motor 15 to the needle cylinder as it is or changed proportionally. Usually, this mechanical transmission unit is a pair of gear wheels interlocking the needle cylinder and the motor 10.

The first controller 30 includes a cylinder motion memory 31, a first detector 32, a second detector 33, a first reading and instructing unit 34, and a stop instructing unit 35. The cylinder motion memory 31 stores a predetermined operating procedure of the needle cylinder, employing a floppy disk or a magnetic tape, and stores all the procedures for rotating the needle cylinder for knitting a unit fabric from the leading end to the trailing end thereof. Namely, as regards knitting the sock shown in FIG. 1, all the procedures for controlling the rotation of the needle cylinder in knitting from the rib top section 1 through the pattern section 2*b* of the leg section 2 to the toe section 5 are stored in the cylinder motion memory 31. A simple magnetic tape may be used for the cylinder motion memory 31, however, any other means capable of storing information such as a floppy disk, punch cards, or mark sheets, may be used.

The first detector 32 is, for example, a rotary encoder, associated with the needle cylinder to detect the angle of rotation of the needle cylinder. Since an angle of rotation of 360 degrees corresponds to one full rotation of the needle cylinder, the first detector 32 simultaneously detects the rotational frequency of the needle cylinder. The detection of a negative angle of rotation indicates the reverse rotation of the needle cylinder, hence the first detector 32 detects also the direction of rotation of the needle cylinder. Usually, a pulse generator interlocked with the needle cylinder is used as the first detector 32. The second detector 33 is associated with the principal parts of the circular knitting machine to detect abnormalities in yarns fed to the needle cylinder and/or the operation of the circular knitting machine. More concretely, the second detector 33 detects yarn breakage and the malfunction of the knitting mechanism, the motor, and the controllers. Various sensors, such as photoelectric sensors, magnetic sensors, and microswitches, are applicable to the second detector 33.

The first reading and instructing unit 34 compares a signal received from the first detector 32 with the contents of the cylinder motion memory 31, reads the procedure of operation of the needle cylinder at the next step corresponding to the angle of rotation of the needle cylinder detected by the first detector 32 from the cylinder motion memory 31, and then gives a signal to the motor 10 to instruct the motor 10 to drive the needle cylinder. Usually, a computer is used as the first reading and instructing unit 34.

The stop instructing unit 35 receives signals from a plurality of detecting heads of the second detector 33 attached to a plurality of the parts of the circular knitting machine and sends a signal to the motor to stop when an abnormality is detected in the yarns and/or any one of the functional parts of the circular knitting machine.

A device, (not shown in FIG. 3) is provided for manually rotating the needle cylinder. Since this device is well known, a description thereof will be omitted.

Figure 3:
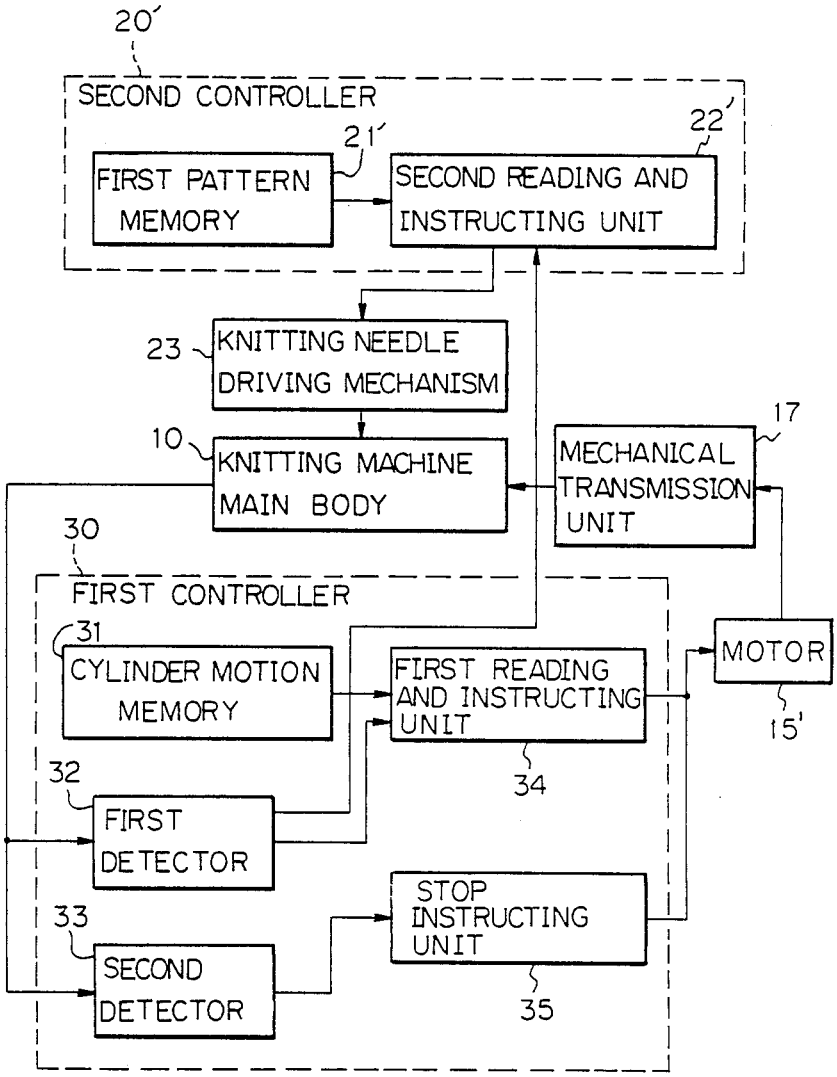
FIG. 3 is a block diagram of the control mechanism of a jacquard circular knitting machine of the present invention.
Figure 4:
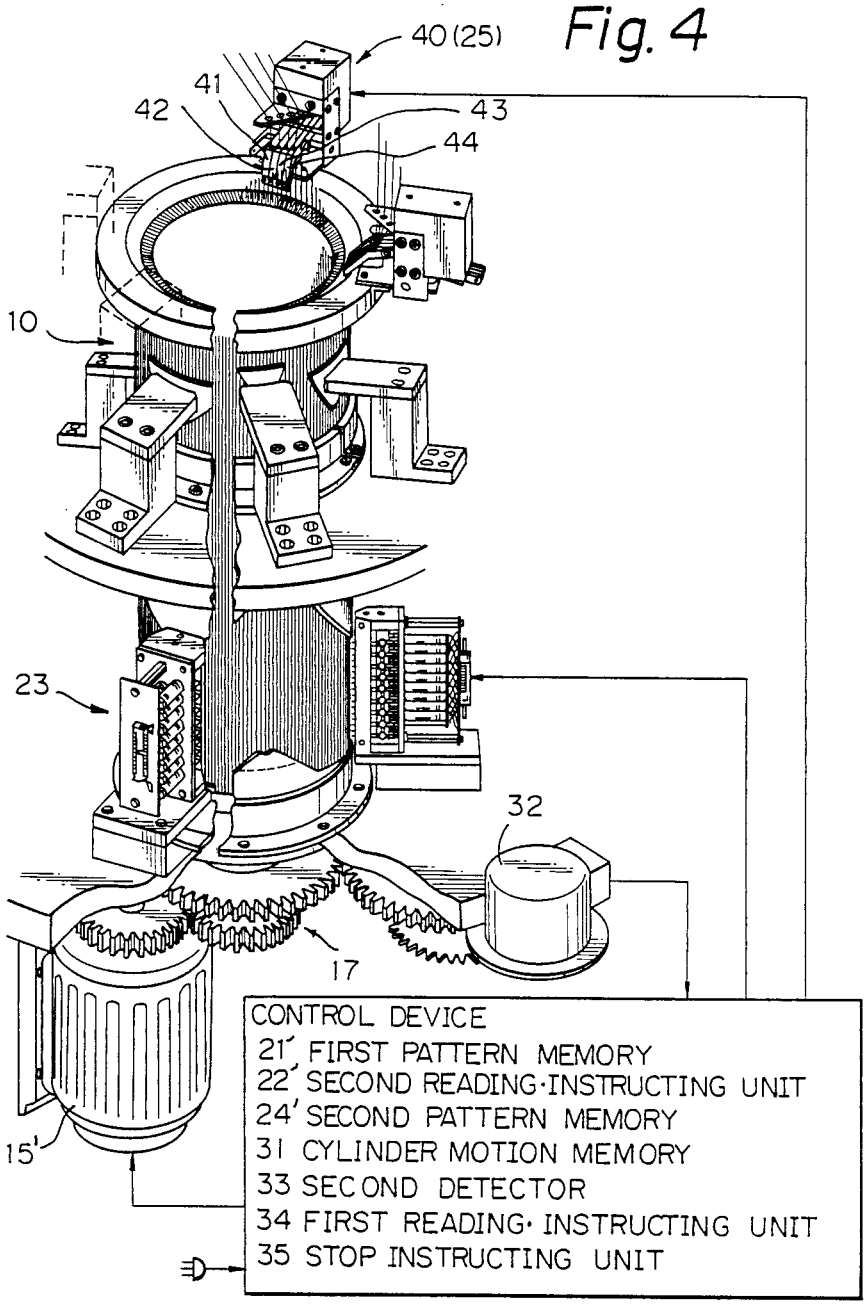
FIG. 4 is a schematic perspective view of a jacquard circular knitting machine in an embodiment according to the present invention.

In the embodiment shown in FIG. 3, a second controller 20′ corresponds to the patterning controller 20 of the patterning mechanism of the well-known conventional circular knitting machine shown in FIG. 2. The constitution of the second controller 20′ is substantially identical with that of the controller 20. The first memory 21′ may be a pin drum or may be memory means, such as magnetic tape, the contents of which is read by a computer. In either case, a signal provided by the first detector 32 of the first controller 30 is applied to the second reading and instructing unit 22′ for driving the knitting needles for vertical sliding motion.

If a magnetic tape is employed as the cylinder motion memory 31′ as in the case of the embodiment of FIG. 3, it is possible, by adapting the first pattern memory 21′, to employ a magnetic tape or the like and integrating the cylinder motion memory 31 and the first pattern memory 21′ into a single magnetic tape device or the like, to store all the procedures of the rotation of the needle cylinder, the vertical sliding motion of the knitting needles corresponding to the rotation of the needle cylinder, and the necessary functions for knitting a complete single unit of the fabric, for instance, for knitting all the parts of a single sock. Furthermore, if necessary two or more magnetic tape devices may be employed so that only necessary information can be changed. In the former case, the first reading and instructing unit 34 and the second reading and instructing unit 22' also are integrated into a single unit, the information read sequentially by internal reading means is processed by an internal arithmetic unit and the processed information is transmitted to the motor 15 and the knitting needle driving mechanism 23. A pushing actuator or a lifting actuator is used as the knitting needle driving mechanism 23.

The pattern knitting operation of the jacquard circular knitting machine according to the present invention will be described in detail hereinafter with reference, by way of example, to knitting the sock having the diamond pattern shown in FIG. 1, in connection with FIG. 5. In this description, the jacquard circular knitting machine is a circular hosiery machine.

The circular hosiery machine has a needle cylinder 3.5 inches in cylinder diameter having 96 needle grooves and four yarn feed units A, B, C, and D. In order to knit the sock of FIG. 1, blended 50% acrylic fiber and 50% wool fiber yarns of 1/36'S yarn count for surface yarns (blue) and core yarns each formed by twisting a nylon filament yarn of 70*d* around a spandex yarn of 40*d* for backside yarn (a solid color) are supplied in parallel to the yarn feed units A and C. Textured nylon filament yarns of 110*d*/2 (deep red) are supplied as pattern yarns to the yarn feed units B and D. FIG. 5 shows a development of the part 2*b* of the leg section 2 of the sock shown in FIG. 1. Accordingly, in FIG. 5, the number of wales is 96, which is equal to the number of the needle grooves of the needle cylinder. Since the pattern has two squares arranged side by side with corners in abutment, the number of courses of the pattern is 48=96/2. The portion of the sock excluding section 2*b* in FIG. 1 is knitted with the surface yarns and the backside yarns fed to the needle cylinder through the yarn feed units A and C. For example, section 2*a* is alternately formed by one course of stitches of the surface and backside yarns fed through the yarn feed unit A and one course of stitches of the surface and backside yarns fed through the yarn feed unit C, while section 2*b* is knitted, as will be described in detail afterward, by rotating the needle cylinder in the normal and reverse directions to knit the diamond pattern. Section 7*a* shown in FIG. 5 is knitted with the surface and backside yarns fed through the yarn feed unit A, and section 7*b* is knitted similarly with the surface and backside yarns fed through the yarn feed unit C. On the other hand, a section 8*a* is knitted with the pattern yarn fed through the yarn feed unit B, while section 8*b* is knitted with the pattern yarn fed through the yarn feed unit D. Consequently, a pattern formed by dark-red rhombic sections 8*a* and 8*b* surrounded by blue sections 7*a* and 7*b* is knitted.

Figure 5:
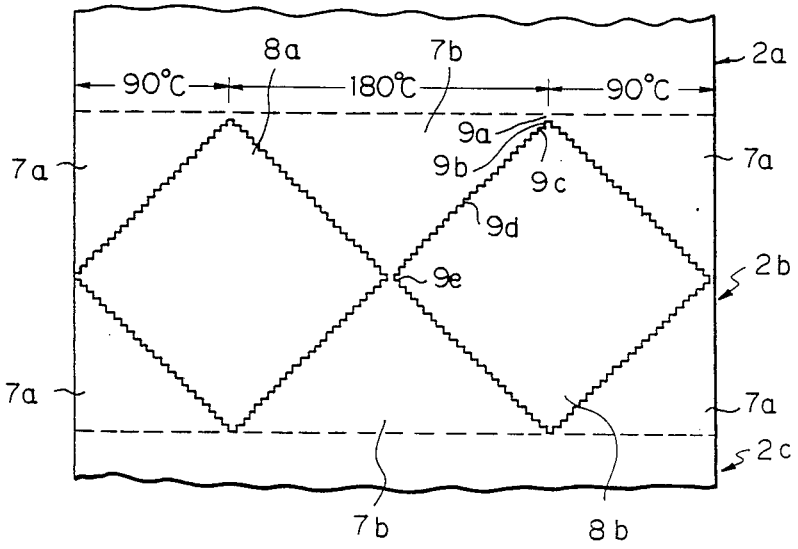
FIG. 5 is an enlarged development of part of a pattern on the sock of FIG. 1.
Figure 6A:
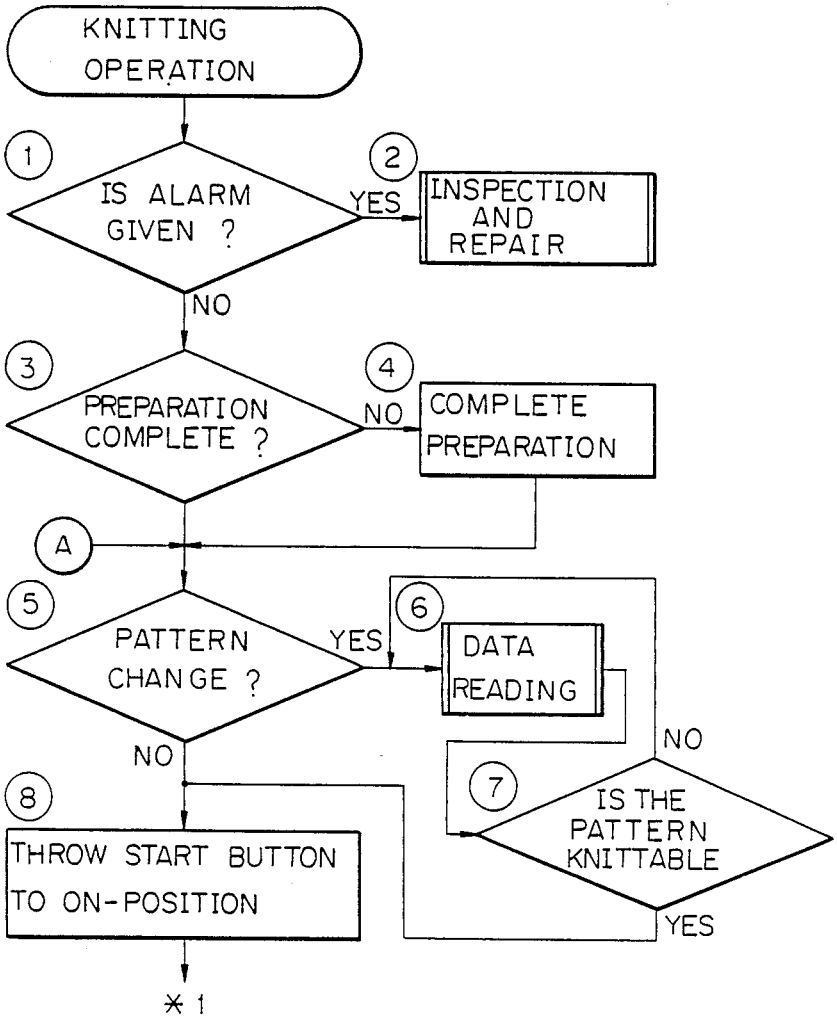
FIGS. 6A to 6D are parts of a flow chart of the steps of a control procedure for knitting the knitted fabric illustrated in FIGS. 1 and 5 on a jacquard circular knitting machine according to the present invention.
Figure 6B:
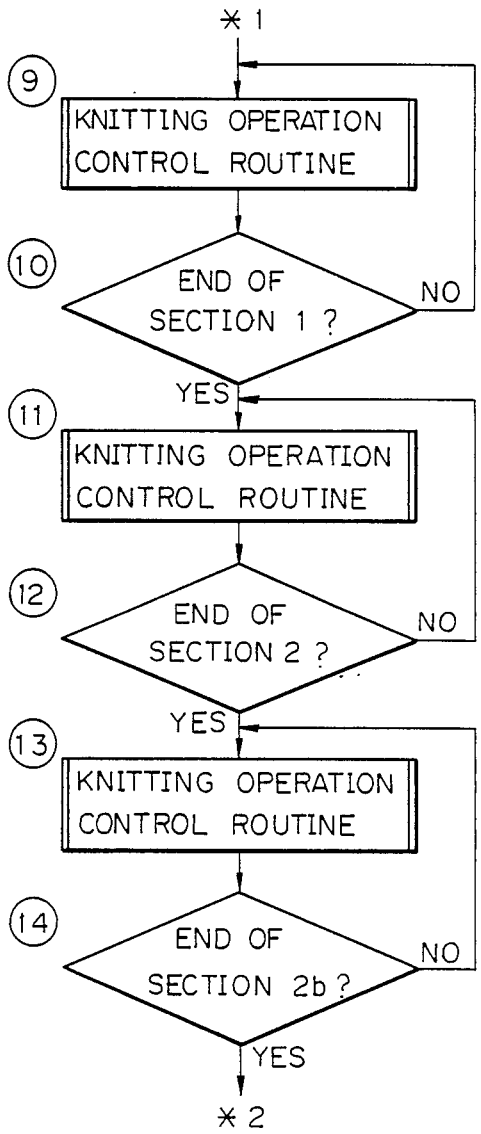
Figure 6C:
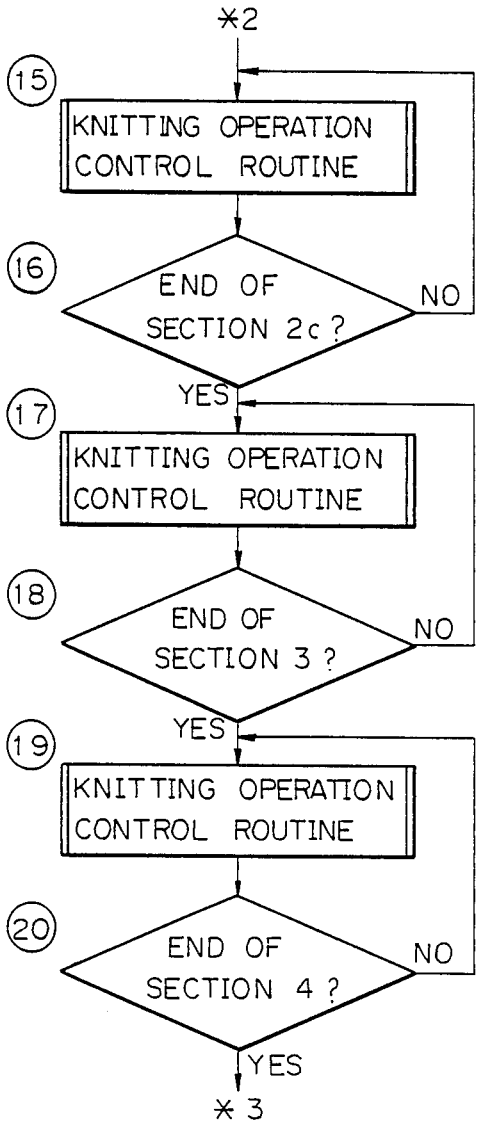
Figure 6D:
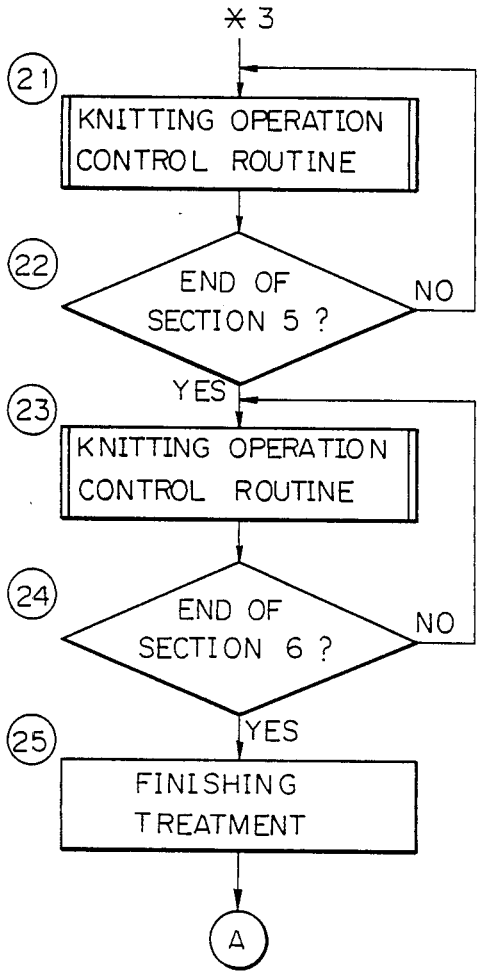

In FIG. 5, the boundaries between the rhombic sections 8*a* and 8*b* and sections 7*a* and 7*b* surrounding the diamond sections 8*a* and 8*b* are indicated by stepped lines, in which one step represents one stitch. The stepped stitches form tuck lines. That is, in FIG. 5, at a point 9*a*, the stitches are formed only with the blue surface yarn, at a position 9*b*, one stitch is formed with the pattern yarn; at a point 9*c*, three stitches are formed with the pattern yarn; at a position 9*d*, 25 stitches are formed with the pattern yarn; and, at a position 9*e*, 47 stitches are formed within the pattern yarn. This pattern knitting process is well-known and nothing new. Such a pattern has conventionally been knitted by rotating the needle cylinder in the normal and reverse directions.

However, in the jacquard circular knitting machine equipped with a well-known conventional mechanical driving mechanism, the needle cylinder is rotated in the normal and reverse directions with mechanical means, such as a sector gear of the driving mechanism. Therefore, once the angle of rotation of the needle cylinder in the normal direction and that in the reverse direction are determined, the needle cylinder is always rotated, when necessary, through a fixed angle of rotation both in the normal direction and in the reverse direction. Accordingly, the needle cylinderis always rotated through the same angle of rotation in knitting stitches at the positions 9*b*, 9*c*, 9*d*, and 9*e*. That is, the needle cylinder must be rotated unavoidably and uselessly through an excessive angle of rotation in knitting a pattern at a certain position, for example, at the position 9*d*.

In the jacquard circular knitting machine according to the present invention, as will be described in detail afterward in connection with FIGS. 6A to 6D, the rotation of the needle cylinder is controlled according to the needle cylinder operating procedures stored in the cylinder motion memory. Therefore, the mode of rotation of the needle cylinder can be changed for every course according to the shape of the pattern merely by storing a needle cylinder controlling program in the cylinder motion memory so that the angle of rotation of the needle cylinder is changed for every course. Referring to FIG. 5, the angle of rotation of the needle cylinder will be explained again hereunder.

(a) Angle of rotation of the needle cylinder at the position 9*b*

The angle of rotation of the needle cylinder for knitting stitches in sections 7*a* and 7*b* in FIG. 5 with the surface yarns fed through the yarn feed units A and C (designated as "angle of rotation for the surface yarn" hereinafter) is $$\left(360^\circ \times \frac{48^\circ - 1^\circ}{96^\circ}\right) + \alpha.$$

An angle of rotation of the needle cylinder for knitting stitches in sections 8*a* and 8*b* in FIG. 5 with the pattern yarns fed through the yarn feed units B and D (designated a "angle of rotation for knitting the pattern yarn" hereinafter) is $$\left(360^\circ \times \frac{1^\circ}{96^\circ}\right) + \alpha.$$

Since the needle cylinder needs to be rotated through the greater one of the above angles, an actually necessary angle of rotation (designated as "necessary angle of rotation" hereinafter) is $$\left(360^\circ \times \frac{48^\circ - 1^\circ}{96^\circ}\right) + \alpha.$$

If the stitching operation is continued while the needle cylinder is rotated in the reverse direction, it is necessary, as is well-known, to rotate the needle cylinder over a predetermined stitch, in order to select knitting needles and form stitches by the action of stitch cams and to hold the stitches with sinkers. The angle $\alpha$ of the above expressions is an angle or rotation through which the needle cylinder rotates over a position corresponding to the predetermined stitch, which is an essential condition of operation to a circular knitting machine capable of rotating the needle cylinder thereof both in the normal and reverse directions.

Ordinarily, the angle $\alpha$ is within a range from 90° to 180°.

(b) Angle of rotation of the needle cylinder at the position 9c

The angle of rotation for the surface yarn is $$\left(360^\circ \times \frac{48^\circ - 3^\circ}{96^\circ}\right) + \alpha.$$

The angle of rotation for the pattern yarn is $$\left(360^\circ \times \frac{3^\circ}{96^\circ}\right) + \alpha.$$

The necessary angle of rotation is $$\left(360^\circ \times \frac{48^\circ - 3^\circ}{96^\circ}\right) + \alpha.$$

(c) Angle of rotation of the needle cylinder at the position 9d

The angle of rotation for the surface yarn is $$\left(360^\circ \times \frac{48^\circ - 25^\circ}{96^\circ}\right) + \alpha.$$

The angle of rotation for the pattern yarn is $$\left(360^\circ \times \frac{25^\circ}{96^\circ}\right) + \alpha.$$

The necessary angle of rotation is $$\left(360^\circ \times \frac{25^\circ}{96^\circ}\right) + \alpha.$$

(d) Angle of rotation of the needle cylinder at the position 9e

The angle of rotation for the surface yarn is $$\left(360^\circ \times \frac{48^\circ - 47^\circ}{96^\circ}\right) + \alpha.$$

The angle of rotation for the pattern yarn is $$\left(360^\circ \times \frac{47^\circ}{96^\circ}\right) + \alpha.$$

The necessary angle of rotation is $$\left(360^\circ \times \frac{47^\circ}{96^\circ}\right) + \alpha.$$

As apparent from the results of the calculations in paragraphs (a) to (d), the necessary angle of rotation became largest at the positions 9b and 9e and the jacquard circular knitting machine of the present invention is capable of reducing the angle of rotation of the needle cylinder for positions other than the positions 9b and 9e. Consequently, the jacquard circular knitting machine of the present invention eliminates the useless rotary motion of the needle cylinder, which is unavoidable in the well-known conventional jacquard circular knitting machine, by changing the angle of rotation of the needle cylinder according to the pattern to be knitted. Therefore, the production efficiency of the jacquard circular knitting machine is improved remarkably.

The above-mentioned features of the jacquard circular knitting machine of the present invention become effective when either yarn needs to be cut during the knitting operation. As is well known, when a predetermined yarn is to be cut during the knitting operation, the needle cylinder needs to be over-rotated further in order to provide a space for cutting the yarn, more concretely, to secure a sufficient length of the yarn to make the yarn engage a cutting device such as a knife. For instance, if the needle cylinder is rotated through an angle of 360° in the normal and reverse directions, the needle cylinder needs to be rotated further approximately by an angle of 40°, so that the needle cylinder is rotated through a total angle of 400° in the normal and reverse directions, in order to enable the yarn cutting operation. In this case, in the conventional jacquard circular knitting machine equipped with a mechanical driving mechanism, as mentioned earlier, since the needle cylinder is driven for rotation in the normal and reverse directions by a mechanical means such as a sector gear, the angle of rotation of the needle cylinder, an angle of 400° by way of example, is fixed once determined and cannot be changed through the knitting operation. Accordingly, even during normal operation in which the yarn cutting operation need not be performed, the needle cylinder is rotated unavoidably and uselessly by an excessive angle of 40° throughout the knitting operation for all the courses.

According to the present invention, the cylinder motion memory 31 stores a program to over-rotate the needle cylinder, for example, by an angle of 40°, at a part of the needle cylinder driving procedure corresponding to the moment of yarn cutting operation. Hence the needle cylinder is driven for rotation in the normal and reverse directions by angles of rotation in accordance with the pattern when the yarn cutting operation is unnecessary. Therefore, the useless rotation of the needle cylinder, which is unavoidable in the well-known conventional jaquard circular knitting machine, is eliminated completely, which also improves the production efficiency of the jacquard circular knitting machine remarkably.

The jacquard circular knitting machine according to the present invention as shown in FIG. 3 has additional features as follows.

First, the possibility of unrestricted change of the angle of rotation of the needle cylinder enables relatively free selection of the disposition of the cams and yarn feed units as compared with the disposition of the same on the conventional jacquard circular knitting machine in which the angle of rotation of the needle cylinder is fixed. Consequently, the decision of camming timing is facilitated and space for providing additional yarn feed units is available.

Second, the elimination of mechanical parts for reversing the needle cylinder provides a compact jacquard circular knitting machine, facilitates maintenance and inspection work, reduces the possibility of malfunctions, and reduces noise generated during the knitting operation.

Third, the simple alteration of the contents of the cylinder motion memory 31 by replacing the magnetic tape cassette enables quick and easy alteration of knitting arrangements.

Knitting procedures for knitting the sock shown in FIGS. 1 and 5 on a jacquard circular knitting machine of the present invention having a single integrated memory unit including the functions of the cylinder motion memory 31 and the first pattern memory 21' shown in FIG. 3 will be described hereinafter in connection with FIGS. 6A to 6D, 7, and 8.

Prior to starting the knitting operation, the normal condition of the knitting machine is confirmed by checking if an alarm is given (step 1). If an alarm is given, inspection is made and the normal condition is restored (step 2). Details of the alarm mode cancellation procedure will be given afterward in connection with FIG. 8.

Confirmation of knitting arrangements, such as the supply of yarns, is made to see if the circular knitting machine is ready for the knitting operation (step 3). If not, the necessary preparation is completed (step 4). Then, confirmation is made to see if pattern alteration is necessary (step 5). If necessary, the magnetic tape is replaced and the data contained in the new magnetic tape is read (step 6) to check if the pattern is knittable on the circular knitting machine (step 7). If pattern alternation is unnecessary or when an appropriate magnetic tape is inserted, the start button is thrown to the ON position (step 8). The knitting operation control routine is read (step 9) and the needle cylinder is turned in the normal direction to form rib stitches to knit section 1, i.e., the rib top section, shown in FIG. 5. A check is made at every end of a course to see if section 1 is completed (step 10). If not, the procedure is returned again to step 9. This process is repeated for every course until the rib knit section 1 of 30 courses is completed. The details of the knitting operation control routine will be described afterward in connection with FIG. 7.

After section 1 has been completed, section 2*a*, i.e., section 2*a* of the leg section 2, is knitted in plain stitches, while the needle cylinder is rotated in the normal direction. First the knitting operation control routine is read (step 11), and 50 courses are knitted, as confirmation of the completion of section 2*a* is made at every completion of a course (step 12).

After section 2*a* has been completed, section 2*b*, namely, section 2*b* of the leg section 2 having a diamond pattern, is knitted by turning the needle cylinder both in the normal direction and in the reverse direction. The knitting operation control routine is read (step 13), and 48 courses are knitted according to the procedure explained in connection with FIG. 5, as confirmation of the completion of section 2*b* is made at every completion of a course (step 14).

After the completion of section 2*b*, section 2*c*, namely, section 2*c* of the leg section 2, of 50 courses is knitted likewise in plain stitches (steps 15 and 16), while the needle cylinder is rotated in the normal direction.

After the completion of section 2*c*, that is, after the completion of the leg section 2, section 3, i.e., the heel section 3, is knitted in plain stitches as a narrowing operation is performed, while the needle cylinder is turned both in the normal direction and in the reverse direction. The knitting operation control routine is read (step 17), and 48 courses are knitted, as the confirmation of completion of section 3 is made at every completion of a course (step 18).

After section 3 has been completed, section 4 (instep and sole section 4), section 5 (toe section 5) and section 6 (not illustrated in FIG. 5, but a waste course section) are knitted (steps 19, 20, 21, 22, 23, and 24) sequentially in similar processes to complete the knitting of one sock (step 25). Then, the procedure goes to (A), namely to the START of the knitting procedure to knit the next sock.

Section 4 is formed of 100 courses of plain stitches knitted by the normal rotation of the needle cylinder, section 5 is formed of 48 courses of plain stitches knitted by the normal and reverse rotations of the needle cylinder, and section 6 is formed of 12 courses of plain stitches knitted by the normal rotation of the needle cylinder.

Figure 7:
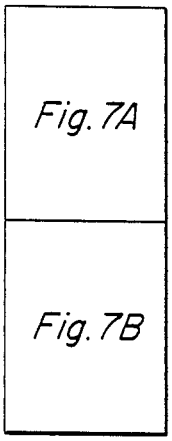
FIG. 7 is a flow chart of the details of the knitting operation control routine shown in FIGS. 6A to 6D.
Figure 7A:
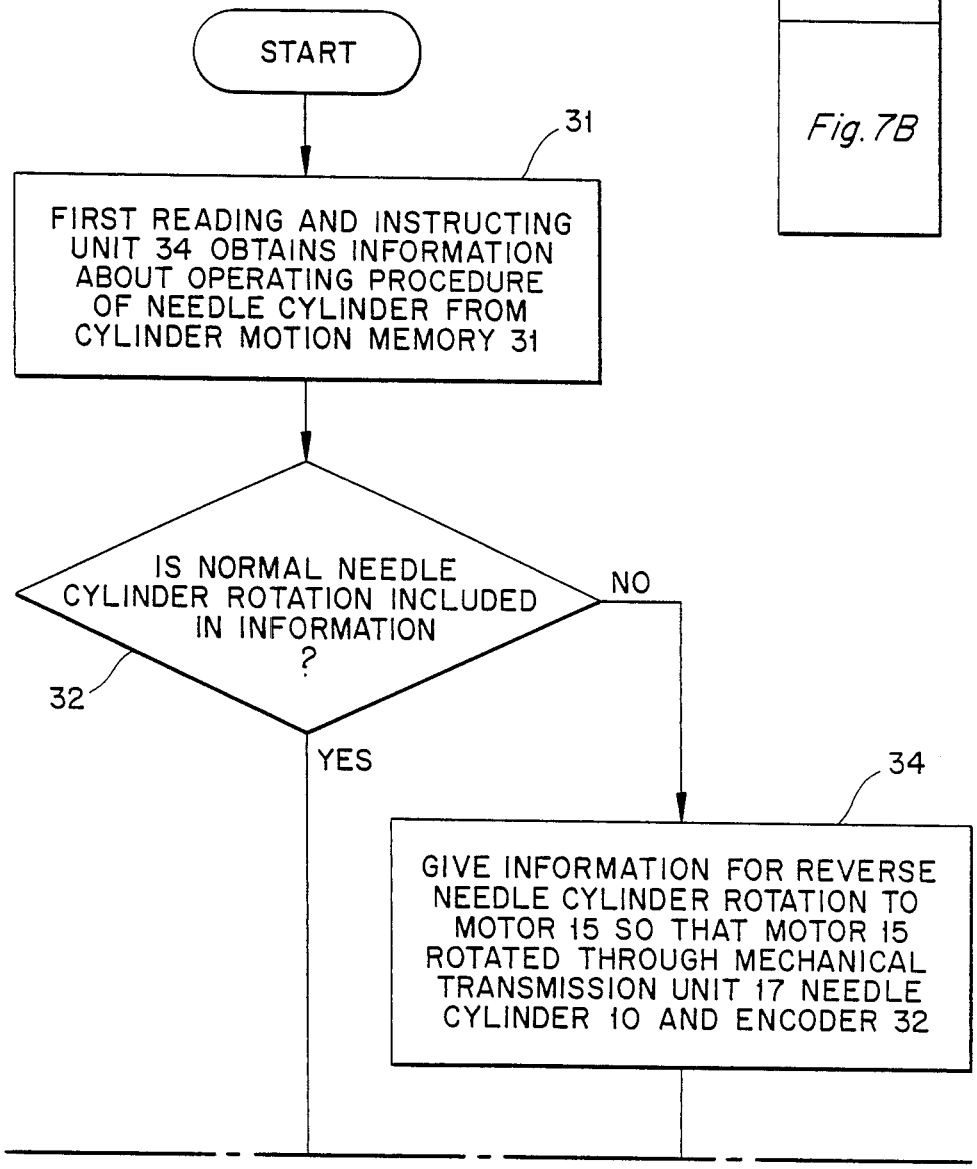
Figure 7B:
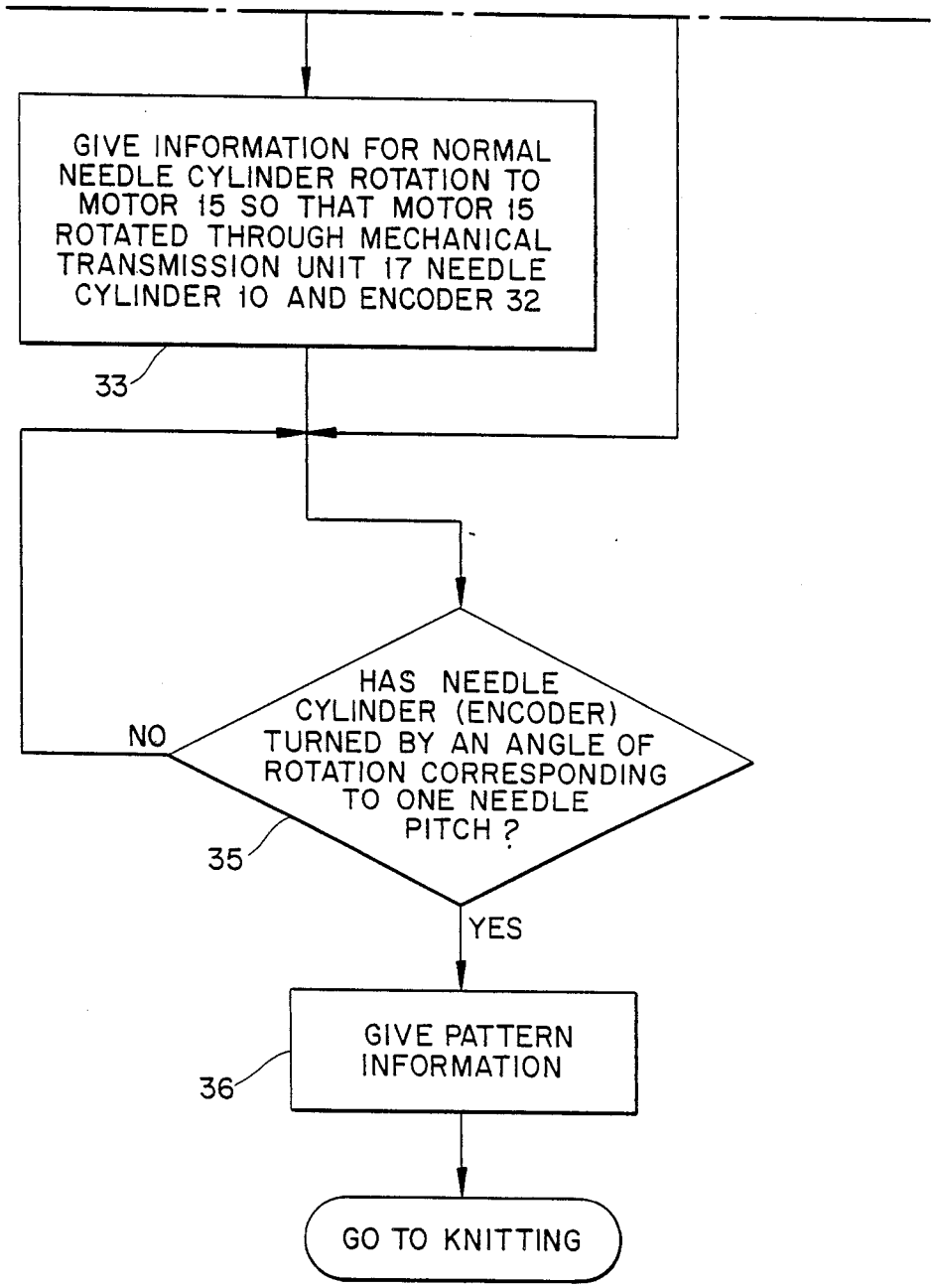

The knitting operation control routine will be described hereinafter in connection with FIG. 7. First, knitted by the normal rotation of the needle cylinder (step 31). If YES, normal rotation information is provided to a motor such that the needle cylinder is rotated in a normal rotational direction (step 32). If NO, reverse rotation information is provided to the motor such that the needle cylinder is rotated in a reverse rotational direction (step 33). After the normal rotation information or the reverse rotation information has been provided to the motor, the movement of the needle cylinder is checked to see if the needle cylinder has been turned through an angle of rotation corresponding to one needle pitch in the normal rotational direction or in the reverse rotational direction the first reading and instructing unit 34 obtains information about an operating procedure of the needle cylinder from the cylinder motion memory 31 (step 31), and the information is checked to determine if it includes a normal cylinder rotation (step 32). If YES, information for normal needle cylinder rotation is provided to the motor 15, the motor 15 through the mechanical transmission unit 17 rotates the needle cylinder 10 in a normal rotational direction and the encoder 32 is also rotated by the needle cylinder 10 (step 33.) If NO, information about a reverse needle cylinder rotation is provided to the motor 15, the motor 15, through the mechanical transmission unit 17, rotates the needle cylinder 10 in a reverse rotational direction and the encoder 32 is also rotated by the needle cylinder 10 (step 34). After the normal rotational information or the reverse rotational information has been provided to the motor, the movement of the needle cylinder 10 is checked to determine whether the needle cylinder 10 has been turned through an angle of rotation corresponding to one needle pitch in the normal rotational direction or in the reverse rotational direction (step 35). If YES, pattern information is provided (step 36). These steps are repeated for every course to carry out the predetermined knitting operation.

Figure 8:
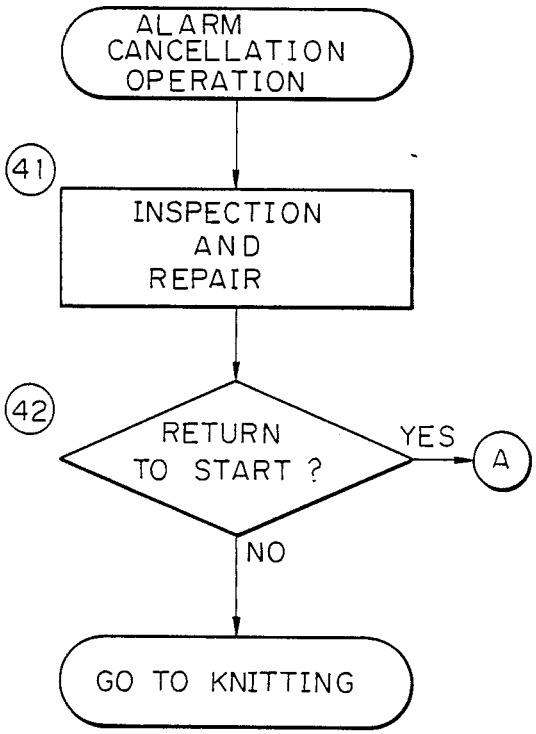
FIG. 8 is a flow chart of the details of the alarm process in FIGS. 6A to 6D.

The alarm mode cancellation routine will be described hereinafter in connection with FIG. 8. The part originating the alarm is inspected and repaired (step 41). After the alarm mode has been cancelled, the present knitting condition is checked to see if the knitting process needs to be returned to the starting position of the knitting procedure stored in the cylinder motion memory (step 42). If YES the procedure goes to (A) of FIG. 6A. If NO, the procedure goes to the next step.

Another embodiment of the present invention will be described hereinafter in connection with FIGS. 4 and 9 to 12A and 12B, as applied to knitting a jacquard fabric, such as a fabric having a combined pattern of a diamond pattern and a stitch pattern, formed by multiple colored yarns by using a number of colored yarns exceeding the number or the yarn feed units in one course.

Generally, in a jacquard circular knitting machine, the possible number of colored yarns in one course of a fabric is equivalent to or less than the number of yarn feed units. When a number of colored yarns exceeding the number of the yarn feed units needs to be stitched into one course, some of the yarn feed units need to be equipped with two or more yarn feed elements and these yarn feed elements need to be switched appropriately several times while one course is knitted. That is, at each yarn feed station, the yarn feed element for feeding a yarn for stitching the diamond pattern is changed to the yarn feed element for feeding a yarn for stitching the stitch pattern. After forming a predetermined number of stitches, the yarn feed element for feeding the yarn for stitching the stitch pattern is changed to the yarn feed element for feeding the yarn for stitching the diamond pattern. The mechanism of a conventional jacquard circular knitting machine is incapable of switching the yarn feed element during the knitting operation at an optional angular position of the needle cylinder relative to the yarn feed station. Accordingly, when a yarn feed element switching operation is necessary, the direction of rotation of the needle cylinder needs to be altered after the yarn feed element switching operation, namely, for example, the diamond pattern and the stitch pattern are knitted necessarily separately. That is, one course of the combined pattern of the diamond pattern and the stitch pattern can be knitted only after one normal turn and one reverse turn of the needle cylinder has been completed.

Figure 10:
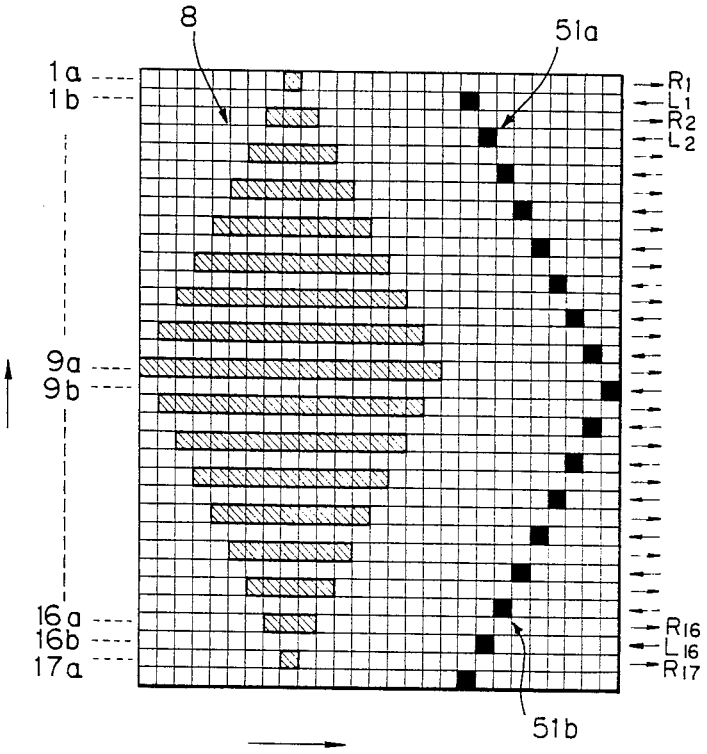
Fig. 10 PRIOR ART
FIG. 10 is an enlarged development of a section of the pattern for explaining the procedure for knitting a pattern including a stitch pattern on a well-known conventional jacquard circular knitting machine.

Such a knitting mode will be described hereunder in connection with FIG. 10, showing a stitching process for knitting a combined pattern of a diamond pattern and a stitch pattern on a conventional jacquard circular knitting machine. FIG. 10 shows the process of stitching a diamond pattern 8 and stitch patterns 51*a* and 51*b* by changing yarns at one yarn feed element switching position. In practice, for example, lines 1*a* and 1*b* form one course on the fabric. In FIG. 10, the arrows $R_1$, $L_1$, . . . , $R_{16}$, $L_{16}$ and $R_{17}$ indicate the direction of rotation of the needle cylinder. As readily understood from FIG. 10, while the needle cylinder turns in the direction $R_1$, one stitch of the diamond pattern 8 is formed, then the yarn feed element feeding a yarn for the diamond pattern 8 is changed to the yarn feed element for feeding a yarn for the stitch pattern 51*a*, and then one stitch of the stitch pattern 51*a* is formed while the needle cylinder turns in the direction $L_1$. The diamond pattern and the chevronwise stitch pattern as shown in FIG. 10 are formed through the repetition of the same knitting operation. Thus, a predetermined number of stitches for the diamond pattern and a predetermined number of stitches for the stitch pattern are formed in one course after the needle cylinder has turned once in the normal direction and once in the reverse direction. Consequently, knitting one course of a section of a fabric having both the diamond pattern and the stitch pattern requires a time twice as long as a time required for knitting one course of the rest of the sections of the fabric.

Figure 11:
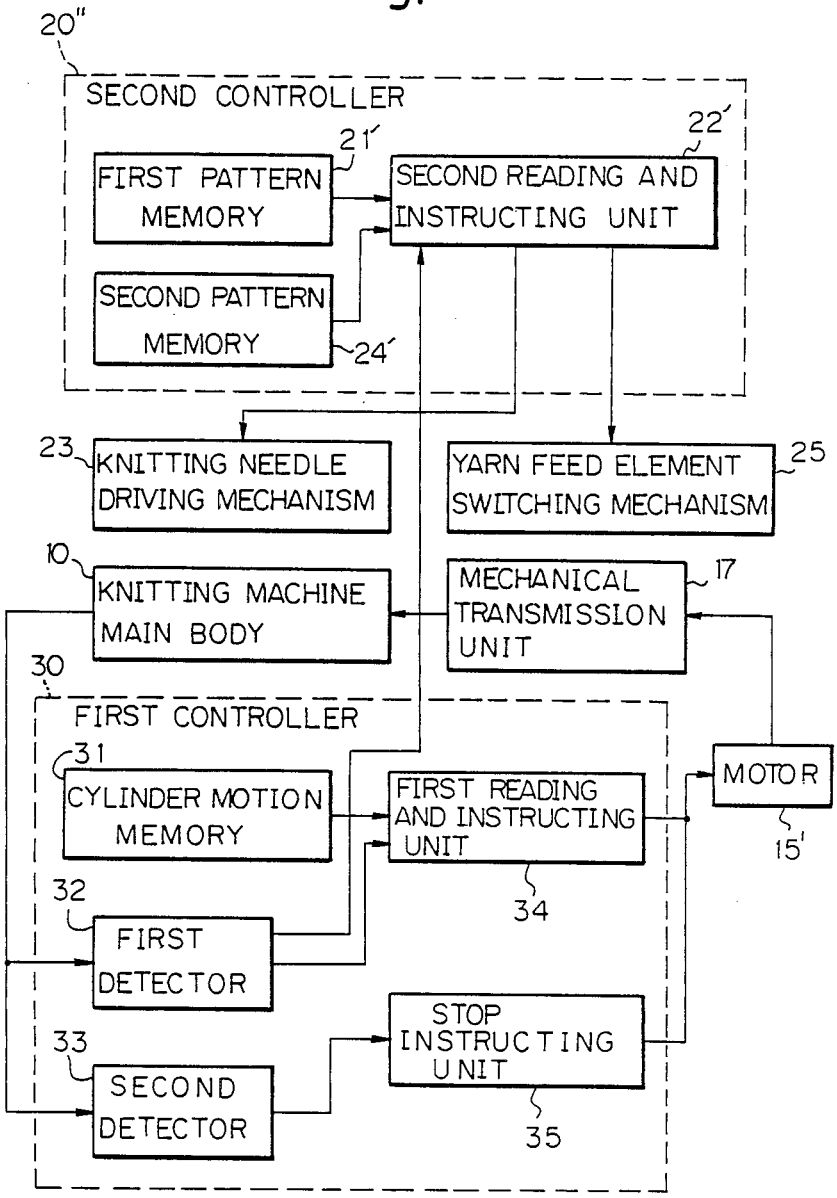
FIG. 11 is a block diagram of the actions of a jacquard circular knitting machine according to the present invention in stitching the pattern shown in FIG. 9.

FIG. 11 is a block diagram of another embodiment of the present invention, capable of solving problems accompanying the above-mentioned yarn feed element switching operation.

It may be readily understood from FIG. 11 that this embodiment is different from the first embodiment having the constitution shown in FIG. 3 only in that a yarn feed element switching mechanism 25 for selectively advancing a plurality of yarn feed elements 41, 42, 43, and 44 of a yarn feed unit 40 to and retracting the same from the respective yarn feed positions (FIG. 4) is included additionally in the patterning mechanism of the constitution shown in FIG. 3 and a second pattern memory which stores a predetermined yarn feed element switching procedure for switching the yarn feed elements 41, 42, 43, and 44 is included additionally in the pattern memory of FIG. 3. A solenoid or an air valve may be used as the yarn feed element switching mechanism 25.

Figure 9:
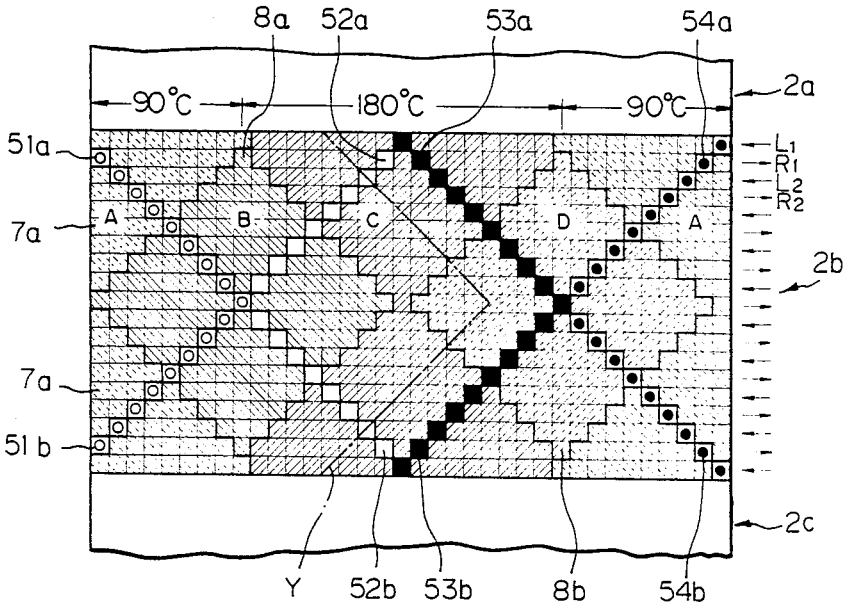
FIG. 9 is an enlarged development of part of a pattern on another sock knitted on the jacquard circular knitting machine according to the present invention.

Accordingly, the knitting operation of the second embodiment is entirely the same as that of the first embodiment, except for the knitting operation concerning the yarn feed element switching operation. The knitting operation concerning the yarn feed element switching operation will be described hereinafter. For convenience sake, the jacquard knitted on the jacquard circular knitting machine of the first embodiment is designated as the ground. Four yarn feed units each having one yarn feed element are provided to feed yarns for knitting the ground. The manner of operation of the second embodiment will be described as applied to knitting section 2*b* of the sock 2 shown in FIG. 1, having diamond patterns 8*a* and 8*b* and stitch patterns 51*a*, 51*b*, 52*a*, 52*b*, 53*a*, 53*b*, 54*a*, and 54*b* as shown in FIG. 9. In this case, each yarn feed unit is provided, in addition to the yarn feed element for knitting the ground, with a yarn feed element for feeding a yarn for knitting the stitch patterns. The relation between the knitting operation for knitting the diamond patterns and the knitting operation for knitting the stitch patterns in forming the diamond patterns with the stitch patterns shown in FIG. 9 will be described with reference to the diamond pattern 8*a* and the stitch patterns 53*a* and 53*b*. Upon the arrival of the yarn feed unit B at a position on a yarn feed element switching line Y during the rotation of the needle cylinder in the direction $R_1$, the yarn feed element switching mechanism of the present invention is actuated to retract the yarn feed element feeding the yarn for the diamond pattern 8*a* and moves the yarn feed element for feeding the yarn for the stitch patterns 53*a* and 53*b* to the yarn feed position. Then, as the needle cylinder rotates further in the direction $R_1$, the stitch pattern 53*a* is formed at a predetermined position. Then, as the needle cylinder rotates in the direction $L_2$, first the stitch pattern 53*a* is formed, and then upon the arrival of the yarn feed unit B at the yarn feed element switching line Y, the yarn feed element for the diamond pattern 8*a* is moved to the yarn feed position so that stitches of the diamond pattern 8*a* are formed. This knitting operation is repeated successively to knit the diamond patterns with the stitch patterns already knitted. As explained earlier, in the jacquard circular knitting machine according to the present invention, the yarn feed element switching operation is performed while the needle cylinder is rotated in one direction. Therefore, the stitches of the diamond pattern and the stitch of the stitch pattern can be formed in the same course while the needle cylinder is rotated in one direction. Accordingly, the time required for knitting such patterns on the jacquard circular knitting machine of the present invention is reduced to half the time required for knitting the same pattern on the conventional jacquard circular knitting machine. Furthermore, as shown in FIG. 9, since the yarn feed element switching position can optionally be changed with the progress of the knitting operation, stitch patterns can be optionally arranged over the ground, which is a further feature of the present invention.

The knitting procedure of the second embodiment will be described hereinafter. The knitting procedure of the second embodiment is the same as that of the first embodiment shown in FIGS. 6A to 6D, 7, and 8, except the flow chart of FIG. 7 is replaced by the knitting operation control routine shown in FIGS. 12A and 12B. Accordingly, the knitting operation control routine among the knitting procedure of the second embodiment will be described in connection with FIGS. 12A and 12B.

First, the pattern is checked to see if the pattern is knittable through the normal rotation of the needle cylinder (step 31). If YES, normal rotation information is provided (step 32). If NO, reverse rotation information is provided (step 33). Then, rotation of the needle cylinder is checked to see if the needle cylinder has been turned by an angle of rotation corresponding to one needle pitch (step 34 or 35) in the normal direction or the reverse direction. If YES, pattern information is provided (step 36). Then, a check is made to see if the yarn feed element switching is necessary (step 37). If YES, yarn feed element switching information is provided (step 38), whereas if NO, a check is made to see if yarn cutting is necessary (step 39). If YES, yarn cutting information is provided (step 40), whereas if NO, the procedure goes to knitting. All the steps of the knitting operation control routine are executed at every stitching operation for a predetermined knitting operation.

Figures 1, 12A:
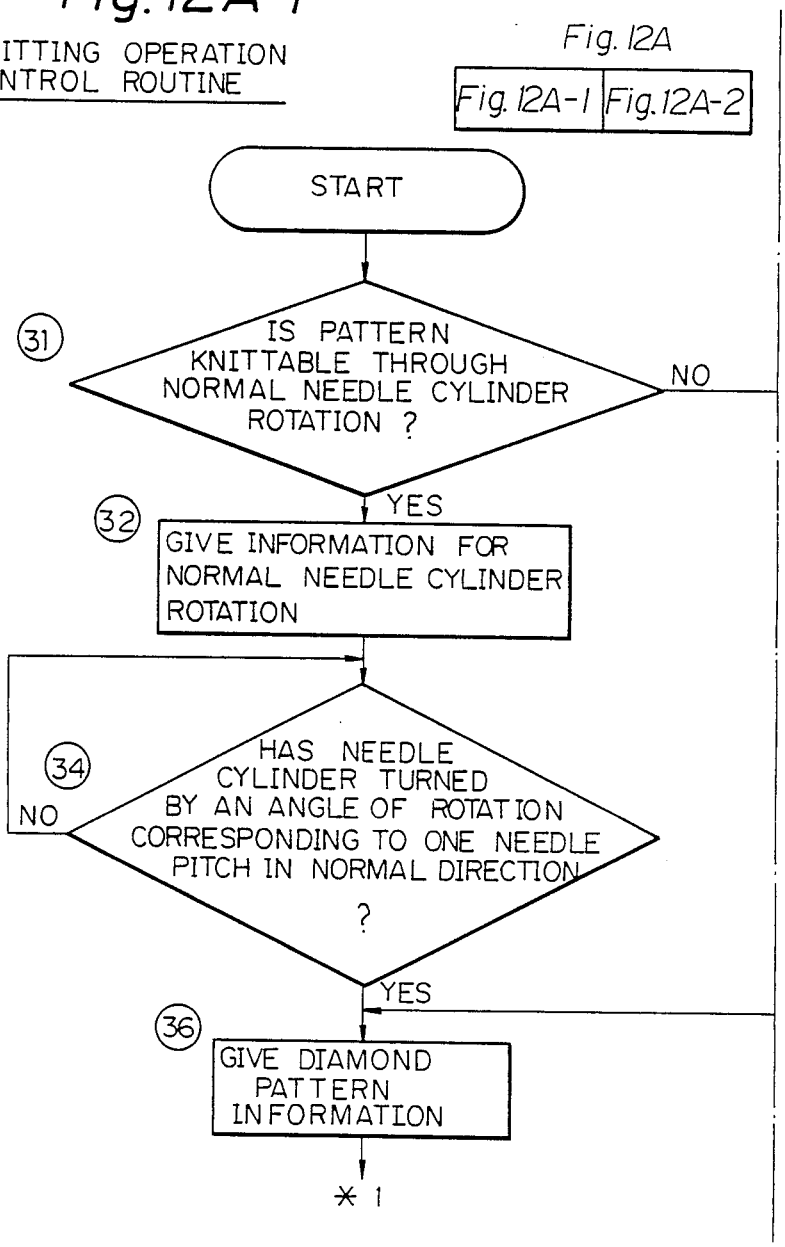
FIGS. 12A to 12B are parts of a flow chart, similar to FIG. 7, showing details of the knitting operation control routine of the flow chart used for knitting the pattern shown in FIG. 9 on a jacquard circular knitting machine employing the constitution shown in FIG. 11.
Figures 2, 12A:
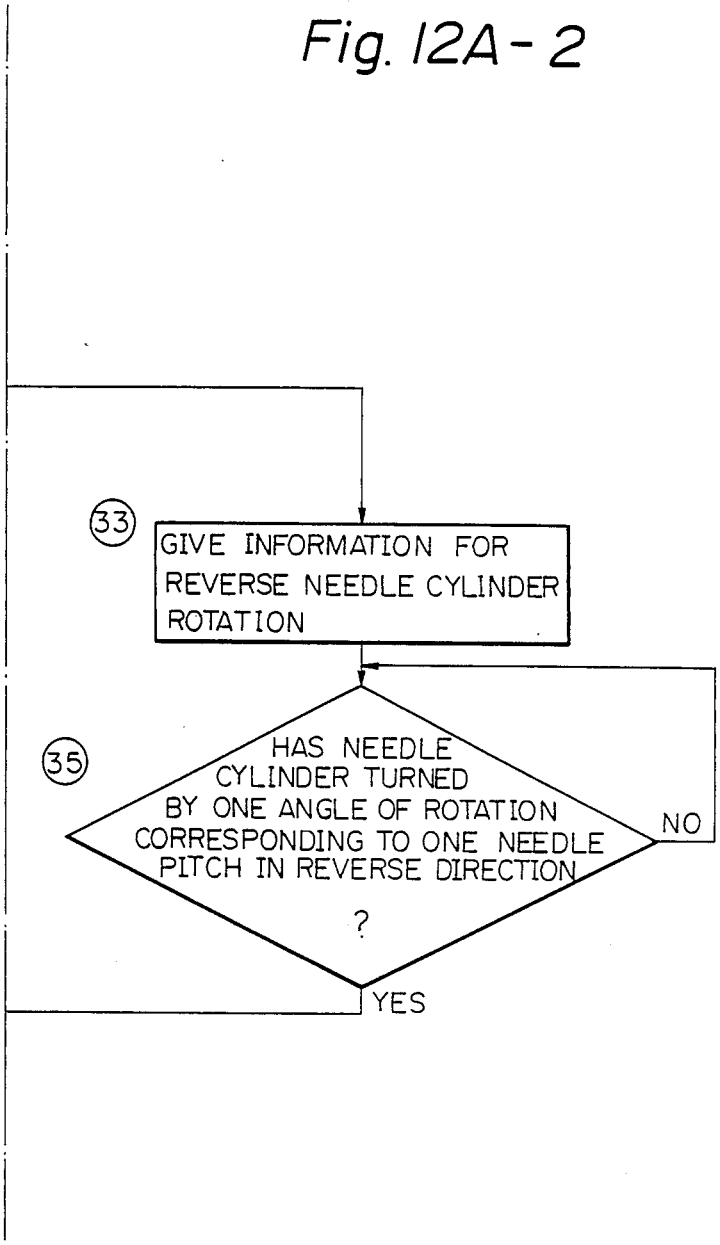
Figure 12B:
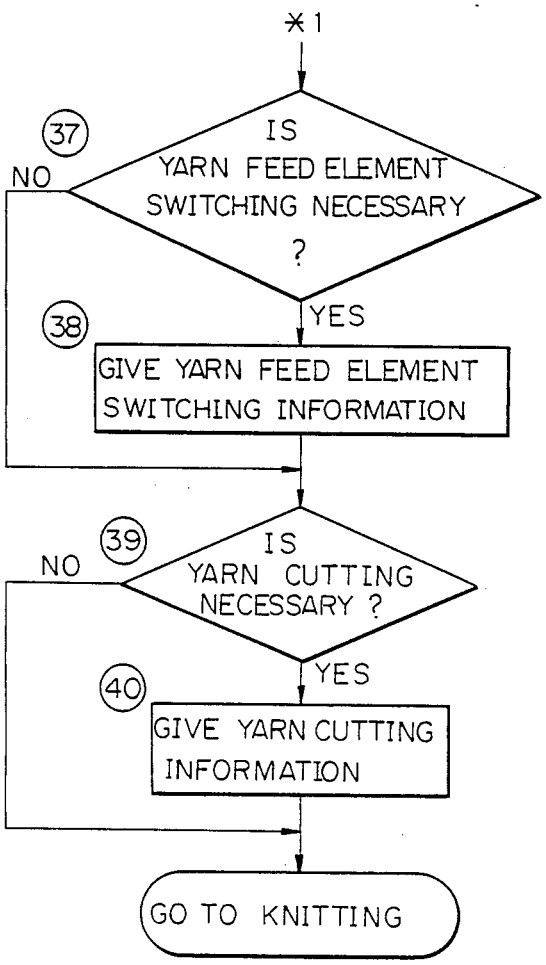

A sock having the diamond patterns with the stitch patterns as shown in FIG. 9 is knitted by the knitting operation according to a combined knitting procedure of the knitting operation control routine of FIGS. 12A and 12B and the knitting procedures of FIGS. 6A to 6D and 8.

The jacquard circular knitting machine, in the second embodiment according to the present invention, is capable of knitting, in addition to the above-mentioned fabric having the diamond patterns with the stitch patterns, other fabrics having patterns formed by using a number of colored yarns exceeding the number of the yarn feed units in one course and capable of knitting the sections having such patterns twice or more as quickly as the conventional jacquard circular knitting machine.

The jacquard circular knitting machine according to the present invention is capable of optionally changing the angle of rotation of the needle cylinder according to the pattern to be knitted and to necessary knitting conditions such as the yarn cutting operation, which eliminates useless rotation of the needle cylinder, and hence enhances the efficiency of production.

Furthermore, the jacquard circular knitting machine having the constitution of the second embodiment of the present invention is capable of knitting sections having stitches of a number of colored yarns exceeding the number of the yarn feed units in a single course twice or more as quickly as the conventional jacquard circular knitting machine, which enhances the efficiency of production of the jacquard circular knitting machine still further.

Furthermore, by not requiring any mechanical part for reversing the needle cylinder, the present invention provides a jacquard circular knitting machine of a compact construction, facilitates maintenance work, reduces malfunctions and failures, and reduces the noise of the jacquard circular knitting machine.

Still further, the present invention enables simple and quick change of the knitting procedure.

Although the invention has been described in its preferred embodiments with a certain degree of particularity as applied to knitting fabrics by using colored yarns, it is to be understood that the yarns to be used are not limited thereto. Yarns of any color or any type suitable for knitting fabrics on the jacquard circular knitting machine can be used, and various changes and modifications may be made in the invention without departing from the spirit and scope thereof.

We claim:

1. A jacquard circular knitting machine comprising a needle cylinder provided thereon with a plurality of patterning functional members including knitting needles, a patterning mechanism capable of controlling at least every knitting needle mounted on the needle cylinder so that the knitting needles are moved vertically to knit a jacquard fabric, a plurality of yarn feed units mounted at predetermined positions around the needle cylinder and each having a plurality of yarn feed elements, yarn feed element switching means for performing a switching operation while the needle cylinder is rotated in either of a first direction and a second direction through a plurality of rotational positions and a driving mechanism for driving the needle cylinder;

said driving mechanism including an electric motor interlocked through mechanical transmission means with the needle cylinder and a first controller which transmits control signals successively to the electric motor to control the rotary motion of the same;

said first conductor including cylinder motion memory means for storing a predetermined cylinder operating procedure which includes a procedure for rotating the needle cylinder so that a plurality of spaced rotational positions of the needle cylinder is determined for each course according to a shape of a pattern to be knitted, first detecting means for detecting and generating a signal for each of said plurality of spaced rotational positions of said needle cylinder, second detecting means for detecting abnormalities in the yarn being fed to the needle cylinder and/or in the operating condition of the jacquard circular knitting machine, first reading and instructing means for comparing each signal given by the first detecting means with the contents of the cylinder motion memory means and instructing the electric motor of needle cylinder driving conditions and to stop the needle cylinder at a variable position predetermined by the shape of the pattern to be knitted, and stop instructing means for instructing the electric motor to stop upon the reception of a signal from the second detecting means;

said patterning mechanism including pattern forming means for operating the patterning functional members of the jacquard circular knitting machine and a second controller for controlling the pattern forming means by successively applying signals to the pattern forming means; and said second controller including pattern memory means for storing a predetermined operation procedure of the patterning functional members and second reading and instruction means for comparing each signal given by the first detecting means of said first controller with the contents of the pattern memory means and instructing the pattern forming means of the operation of the patterning functional members;

said pattern forming means includes the needle driving means for driving the knitting needles for vertical motion and the yarn feed element switching means which move at least one of the yarn feed elements to the respective yarn feed positions and retract the same from the yarn feeding positions, and said pattern memory means includes first pattern memory means for storing a predetermined knitting needle driving procedure and second memory means for storing a predetermined yarn feed element switching procedure for controlling a plurality of the yarn feed elements so that each vertical motion of said knitting needles and each yarn feed element switching motion during knitting of the jacquard fabric is controlled at each of said plurality of spaced rotational positions of the needle cylinder as determined by said first pattern memory and said second pattern memory.

2. A jacquard circular knitting machine according to claim 1, wherein said cylinder motion memory means is a floppy disk.

3. A jacquard circular knitting machine according to claim 1, wherein said cylinder motion memory means is a magnetic tape.

4. A jacquard circular knitting machine according to claim 1, wherein said first detecting means is a rotary encoder.

5. A jacquard circular knitting machine according to claim 1, wherein said second detecting means is a microswitch.

6. A jacquard circular knitting machine according to claim 1, wherein said second detecting means is a photoelectric sensor.

7. A jacquard circular knitting machine according to claim 1, wherein said second detecting means is a magnetic sensor.

8. A jacquard circular knitting machine according to claim 1, wherein said first reading and instructing means and said second reading and instructing means are computer controlled devices.

9. A jacquard circular knitting machine according to claim 1, wherein said first pattern memory means is a floppy disk.

10. A jacquard circular knitting machine according to claim 1, wherein said first pattern memory means is a magnetic tape.

11. A jacquard circular knitting machine according to claim 1, wherein said yarn feed element switching means include solenoids.

12. A jacquard circular knitting machine according to claim 1, wherein said yarn feed element switching means include air valves.

13. A jacquard circular knitting machine according to claim 1, wherein said first pattern memory means and said second pattern memory means include floppy disks.

14. A jacquard circular knitting machine according to claim 1, wherein said first pattern memory means and said second pattern means include magnetic tapes.

* * * * *